US010704230B2

(12) United States Patent
Matsuzaki et al.

(10) Patent No.: US 10,704,230 B2
(45) Date of Patent: Jul. 7, 2020

(54) SHOVEL

(71) Applicants: SUMITOMO HEAVY INDUSTRIES, LTD., Tokyo (JP); SUMITOMO(S.H.I.) CONSTRUCTION MACHINERY CO., LTD., Tokyo (JP)

(72) Inventors: Eisuke Matsuzaki, Kanagawa (JP); Daisuke Kitajima, Chiba (JP)

(73) Assignees: SUMITOMO HEAVY INDUSTRIES, LTD., Tokyo (JP); SUMITOMO (S.H.I.) CONSTRUCTION MACHINERY CO., LTD., Tokyo (JP)

( * ) Notice: Subject to any disclaimer, the term of this patent is extended or adjusted under 35 U.S.C. 154(b) by 111 days.

(21) Appl. No.: 15/409,779

(22) Filed: Jan. 19, 2017

(65) Prior Publication Data

US 2017/0130428 A1 May 11, 2017

Related U.S. Application Data

(63) Continuation of application No. PCT/JP2015/071467, filed on Jul. 29, 2015.

(30) Foreign Application Priority Data

Jul. 30, 2014 (JP) ..... 2014-154943

(51) Int. Cl.
*E02F 9/22* (2006.01)
*F02D 29/04* (2006.01)
(Continued)

(52) U.S. Cl.
CPC ..... *E02F 9/2246* (2013.01); *E02F 3/32* (2013.01); *E02F 9/20* (2013.01); *E02F 9/2235* (2013.01);
(Continued)

(58) Field of Classification Search
CPC ..... E02F 9/2246; E02F 9/2296; E02F 9/2235; E02F 3/32; E02F 9/20; E02F 9/2292; F02D 29/04; F02D 29/00; F02D 45/00
See application file for complete search history.

(56) References Cited

U.S. PATENT DOCUMENTS 6,672,055 B1 * 1/2004 Konishi ..... E02F 9/2235 60/449
2009/0293470 A1 12/2009 Tsukamoto et al.
(Continued)

FOREIGN PATENT DOCUMENTS

JP H06-241212 8/1994
JP H07-127605 5/1995
(Continued)

OTHER PUBLICATIONS

How to Build Racing Engines: Torque and Horsepower Guide; Muscle Car DIY; 2015 (Year: 2015).*
International Search Report dated Oct. 20, 2015.

*Primary Examiner* — Alan D Hutchinson
(74) *Attorney, Agent, or Firm* — IPUSA, PLLC

(57) ABSTRACT

A shovel includes a lower traveling body, an upper rotating body, an attachment including a boom and an arm, a controller, an engine, and a hydraulic pump that is driven by the engine and discharges hydraulic oil to drive the attachment. The controller is configured to obtain a hydraulic load applied to the attachment and calculate an engine speed command at predetermined time intervals based on the obtained hydraulic load.

14 Claims, 10 Drawing Sheets

(51) Int. Cl.

| | |
|---|---|
| ***E02F 9/20*** | (2006.01) |
| ***F02D 29/00*** | (2006.01) |
| ***F02D 45/00*** | (2006.01) |
| ***E02F 3/32*** | (2006.01) |

(52) U.S. Cl.
CPC ..... *E02F 9/2296* (2013.01); *F02D 29/00* (2013.01); *F02D 29/04* (2013.01); *F02D 45/00* (2013.01); *E02F 9/2292* (2013.01)

(56) References Cited

U.S. PATENT DOCUMENTS

| | | | | |
|---|---|---|---|---|
| 2013/0190960 | A1* | 7/2013 | Kawashima ..... | B60W 10/06<br>701/22 |
| 2013/0325268 | A1 | 12/2013 | Ishihara et al. | |
| 2014/0020375 | A1* | 1/2014 | Fujishima ..... | B60W 20/00<br>60/431 |
| 2015/0176252 | A1* | 6/2015 | Kim ..... | B60W 30/1888<br>701/50 |

FOREIGN PATENT DOCUMENTS

| | | |
|---|---|---|
| JP | 2000-161302 | 6/2000 |
| JP | 2001-090574 | 4/2001 |
| JP | 2001-193702 | 7/2001 |
| JP | 2009-216058 | 9/2009 |
| JP | 4806014 | 11/2011 |
| JP | 2012-180683 | 9/2012 |
| JP | 2012-246631 | 12/2012 |
| WO | 2010/150382 | 12/2010 |
| WO | 2012/046788 | 4/2012 |

* cited by examiner

SHOVEL

RELATED APPLICATIONS

The present application is a continuation application filed under 35 U.S.C. 111(a) claiming benefit under 35 U.S.C. 120 and 365(c) of PCT International Application No. PCT/JP2015/071467 filed on Jul. 29, 2015, which is based on and claims the benefit of priority of Japanese Patent Application No. 2014-154943 filed on Jul. 30, 2014, the entire contents of which are incorporated herein by reference.

BACKGROUND

Technical Field

An aspect of this disclosure relates to a shovel including an engine and a hydraulic pump driven by the engine.

Description of Related Art

There exists an overload protection device for a construction machine that prevents the occurrence of an engine lug-down resulting from a sharp increase in the discharge pressure of a hydraulic pump, and thereby prevents a sharp increase in the fuel injection amount.

When it is determined that an operation lever of the construction machine is operated at a speed greater than or equal to a predetermined speed, the overload protection device temporarily decreases the maximum allowable value of torque that the hydraulic pump can absorb This is to prevent the discharge rate of the hydraulic pump from increasing sharply in response to the sharp increase in the discharge pressure of the hydraulic pump, and thereby prevent the pump absorption torque from exceeding the engine output torque. This in turn makes it possible to reduce the fuel consumption of the construction machine and to improve the maneuverability of, for example, a hydraulic actuator. On the other hand, when engine speed decreases, the device increases the fuel injection amount to cause the engine speed to return to the rated speed.

SUMMARY

In an aspect of this disclosure, there is provided a shovel including a lower traveling body, an upper rotating body, an attachment including a boom and an arm, a controller, an engine, and a hydraulic pump that is driven by the engine and discharges hydraulic oil to drive the attachment. The controller is configured to obtain a hydraulic load applied to the attachment and calculate an engine speed command at predetermined time intervals based on the obtained hydraulic load.

DETAILED DESCRIPTION

The overload protection device described above is not configured to actively control the output torque of an engine to which isochronous control is applied, to prevent the occurrence of an engine lug-down resulting from a sharp increase in the discharge pressure of a hydraulic pump. Accordingly, the overload protection device has room for improvement in terms of suppressing the variation in engine speed.

An aspect of this disclosure provides a shovel that can more reliably suppress the variation in engine speed resulting from a change in pump absorption torque.

Figure 1:
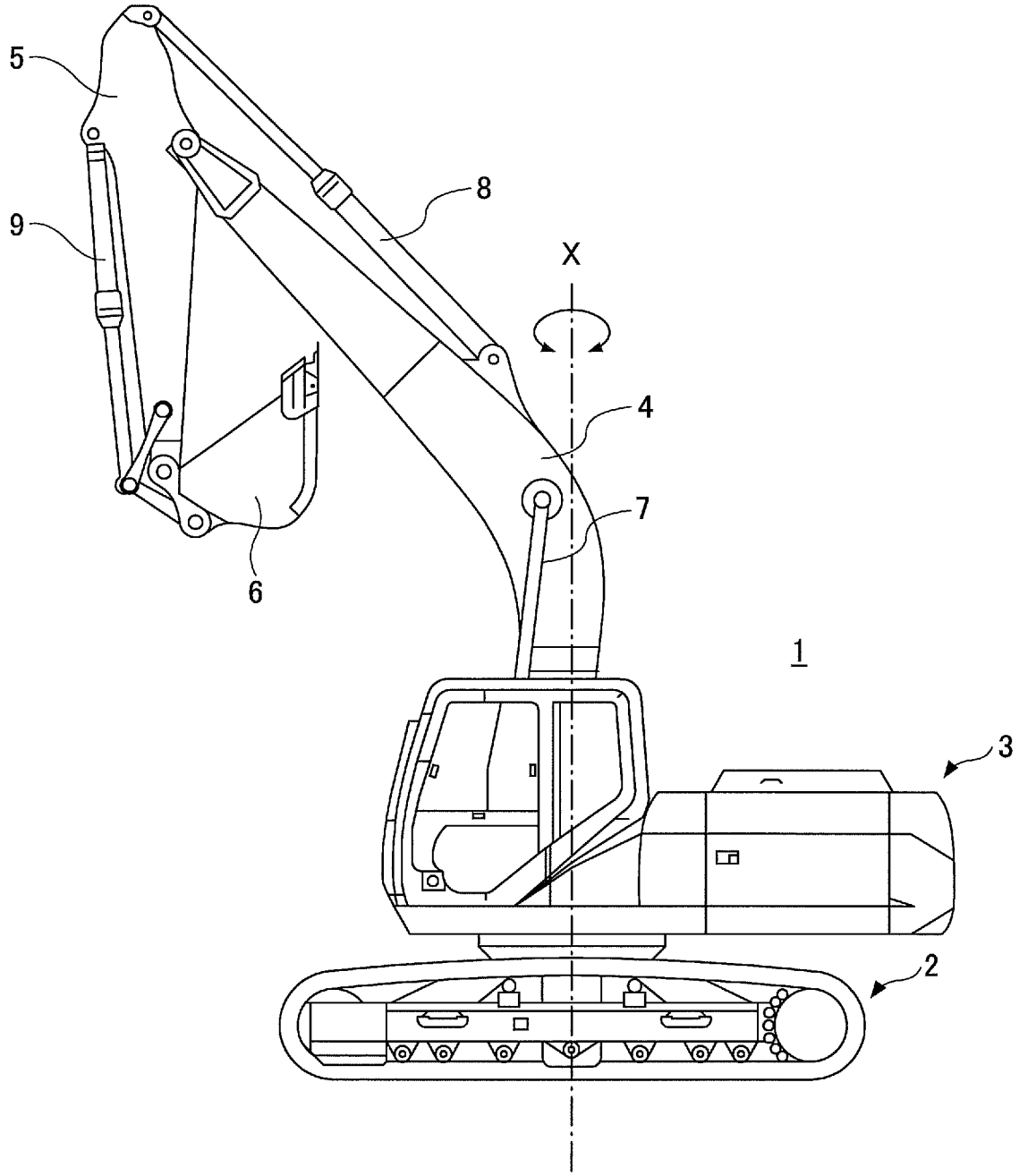
FIG. 1 is a drawing illustrating an exemplary configuration of a shovel according to an embodiment.

Embodiments of the present invention are described below with reference to the accompanying drawings. FIG. 1 is a drawing illustrating an exemplary configuration of a shovel (excavator) that is an example of a construction machine according to an embodiment. A shovel 1 includes a crawler-type lower traveling body 2, and an upper rotating body 3 that is mounted via a rotating mechanism on the lower traveling body and is rotatable about an X axis. An excavating attachment, which is an example of an attachment, is provided on a front center portion of the upper rotating body 3. The excavating attachment includes a boom 4, an arm 5, and a bucket 6. Any other attachment such as a lifting magnet attachment may instead be provided on the upper rotating body 3.

Figure 2:
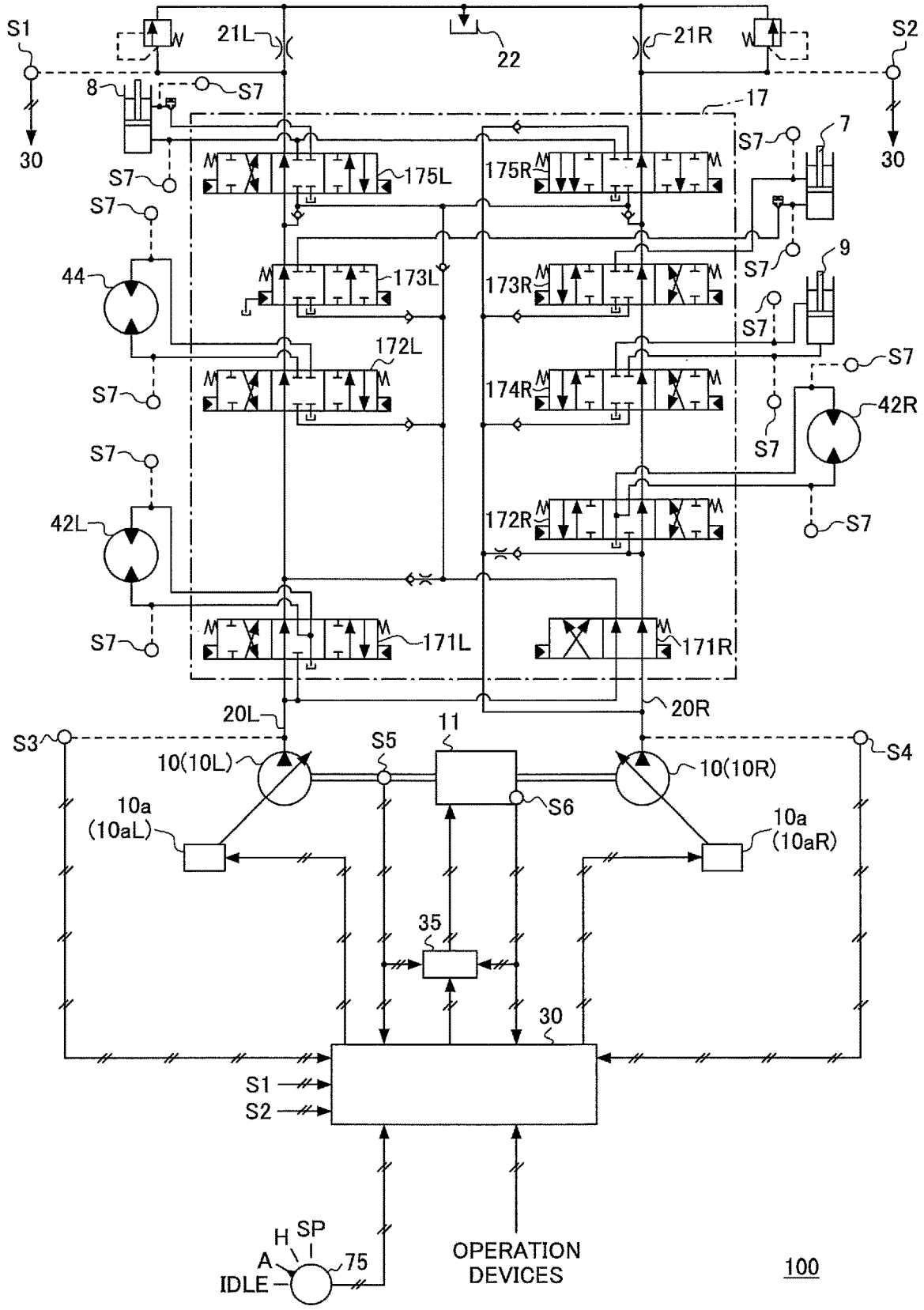
FIG. 2 is a drawing illustrating an exemplary configuration of a drive system of the shovel of FIG. 1.

FIG. 2 is a drawing illustrating a drive system 100 of the shovel 1. The drive system 100 includes hydraulic pumps 10, an engine 11, a control valve system 17, a controller 30, and an engine controller 35.

The hydraulic pumps 10 are driven by the engine 11. In the present embodiment, each hydraulic pump 10 is a variable-displacement, swash-plate hydraulic pump whose discharge rate per revolution (actual displacement [cc/rev]) is variable. The actual displacement [cc/rev] is controlled by a pump regulator 10*a*. More specifically, the hydraulic pumps 10 include a hydraulic pump 10L whose discharge rate is controlled by a pump regulator 10*a*L and a hydraulic pump 10R whose discharge rate is controlled by a pump regulator 10*a*R. Also, in the present embodiment, the rotational shaft of the hydraulic pump 10 is coupled to the rotational shaft of the engine 11 and rotates at the same rotation speed as the rotation speed of the engine 11. Also, the rotational shaft of the hydraulic pump 10 is coupled to a flywheel. The flywheel suppresses variation in the rotation speed resulting from variation in engine output torque.

The engine 11 is a driving source of the shovel 1. In the present embodiment, the engine 11 is a diesel engine including a turbocharger as a booster and a fuel injector, and is provided in the upper rotating body 3. The engine 11 may include a supercharger as a booster.

The control valve system 17 is a hydraulic control mechanism that supplies hydraulic oil discharged from the hydraulic pumps 10 to various hydraulic actuators. In the present embodiment, the control valve system 17 includes control valves 171L, 171R, 172L, 172R, 173L, 173R, 174R, 175L, and 175R. The hydraulic actuators include a boom cylinder 7, an arm cylinder 8, a bucket cylinder 9, a left traveling hydraulic motor 42L, a right traveling hydraulic motor 42R, and a rotating hydraulic motor 44.

Specifically, the hydraulic pump 10L circulates hydraulic oil through a center bypass pipe line 20L, which passes through the control valves 171L, 172L, 173L, and 175L, to a hydraulic oil tank 22. Similarly, the hydraulic pump 10R circulates hydraulic oil through a center bypass pipe line 20R, which passes through the control valves 171R, 172R, 173R, 174R, and 175R, to the hydraulic oil tank 22.

The control valve 171L is a spool valve that controls the flow rate and the flow direction of the hydraulic oil between the left traveling hydraulic motor 42L and the hydraulic pump 10L.

The control valve 171R is a spool valve that functions as a straight travel valve. The control valve 171R switches the flow of the hydraulic oil so that the hydraulic oil is supplied from the hydraulic pump 10L to each of the left traveling hydraulic motor 42L and the right traveling hydraulic motor 42R, and the straight line stability of the lower travelling body 2 is improved. More specifically, when the left traveling hydraulic motor 42L, the right traveling hydraulic motor 42R, and another hydraulic actuator are operated at the same time, the hydraulic pump 10 supplies the hydraulic oil to both of the left traveling hydraulic motor 42L and the right traveling hydraulic motor 42R. In other cases, the hydraulic pump 10L supplies the hydraulic oil to the left traveling hydraulic motor 42L and the hydraulic pump 10R supplies the hydraulic oil to the right traveling hydraulic motor 42R.

The control valve 172L is a spool valve that controls the flow rate and the flow direction of the hydraulic oil between the rotating hydraulic motor 44 and the hydraulic pump 10L. The control valve 172R is a spool valve that controls the flow rate and the flow direction of the hydraulic oil between the right traveling hydraulic motor 42R and the hydraulic pumps 10L and 10R.

The control valves 173L and 173R are spool valves that control the flow rates and the flow directions of the hydraulic oil between the boom cylinder 7 and the corresponding hydraulic pumps 10L and 10R. The control valve 173R is driven when a boom operation lever, which is an operation device, is operated. The control valve 173L is driven when the boom operation lever is operated in a boom raising direction by an amount greater than or equal to a predetermined lever operation amount.

The control valve 174R is a spool valve that controls the flow rate and the flow direction of the hydraulic oil between the hydraulic pump 10R and the bucket cylinder 9.

The control valves 175L and 175R are spool valves that control the flow rates and the flow directions of the hydraulic oil between the arm cylinder 8 and the corresponding hydraulic pumps 10L and 10R. The control valve 175L is driven when an arm operation lever, which is an operation device, is operated. The control valve 175R is driven when the arm operation lever is operated by an amount greater than or equal to a predetermined lever operation amount.

The center bypass pipe lines 20L and 20R, respectively, include negative control throttles 21L and 21R between the most downstream flow control valves 175L and 175R and the hydraulic oil tank 22. The negative control throttles 21L and 21R, respectively, limit the flows of the hydraulic oil discharged from the hydraulic pumps 10L and 10R to generate negative control pressures at positions upstream of the negative control throttles 21L and 21R.

The controller 30 is a functional component for controlling the shovel 1 and is, for example, a computer including a CPU, a RAM, a ROM, and an NVRAM.

In the present embodiment, the controller 30 electrically detects operations (e.g., whether a lever is operated, a lever operation direction, and a lever operation amount) of various operation devices based on outputs of a pilot pressure sensor(s) (not shown). The pilot pressure sensor is an example of an operation detector for measuring a pilot pressure that is generated when an operation device such as an arm operation lever or a boom operation lever is operated. Alternatively, the operation detector may be implemented by a sensor other than a pilot pressure sensor. For example, the operation detector may be implemented by an inclination sensor that detects an inclination of an operation lever.

The controller 30 also electrically detects operation states of the engine 11 and various hydraulic actuators based on outputs from sensors S1 through S7.

Pressure sensors S1 and S2 detect negative control pressures generated upstream of the negative control throttles 21L and 21R, and output the detected negative control pressures as electric negative control pressure signals to the controller 30.

Pressure sensors S3 and S4 detect discharge pressures of the hydraulic pumps 10L and 10R, and output the detected discharge pressures as electric discharge pressure signals to the controller 30.

An engine speed sensor S5 detects the speed of the engine 11, and outputs the detected speed as an electric engine speed signal to the controller 30 and the engine controller 35.

A boost pressure sensor S6 detects a boost pressure of the engine 11, and outputs the detected boost pressure as an electric boost pressure signal to the controller 30 and the engine controller 35. In the present embodiment, the boost pressure sensor S6 detects the intake pressure (boost pressure) increased by a turbocharger. The controller 30 may instead be configured to obtain the output of the boost pressure sensor S6 via the engine controller 35.

Actuator pressure sensors S7 detect pressures of the hydraulic oil in the respective hydraulic actuators, and output the detected pressures as electric actuator pressure signals to the controller 30.

According to detected operations of the operation devices and detected operation states of the hydraulic actuators, the controller 30 causes the CPU to execute programs corresponding to various functional components.

The engine controller 35 is a device that controls the engine 11. In the present embodiment, the engine controller 35 controls (isochronous control) the engine 11 at a constant speed according to an engine speed command that is received at predetermined time intervals from the controller 30 via CAN communications. More specifically, at a predetermined control cycle, the engine controller 35 calculates a speed deviation between an engine speed command received from the controller 30 at the predetermined control cycle and an actual engine speed detected by the engine speed sensor S5 at the predetermined control cycle. Then, at the predetermined control cycle, the engine controller 35 increases or decreases the engine output torque by increasing or decreasing the fuel injection amount according to the calculated speed deviation. That is, the engine controller 35 performs a feedback control of the engine speed at the predetermined control cycle.

Also, the controller 30 can increase or decrease the fuel injection amount and eventually the engine output torque in advance by increasing or decreasing the engine speed command at the predetermined control cycle in a feedforward manner. Accordingly, the controller 30 can suppress the variation in the engine speed by increasing or decreasing the engine output torque according to an engine load before the engine speed varies. Thus, the controller 30 can prevent a lug-down of the engine 11 due to a response delay resulting from the feedback control described above. Also, the controller 30 can prevent a decrease in responsiveness of hydraulic actuators at start-up that is caused by a decrease in the pumping rate resulting from a decrease in the engine speed. Also, because the controller 30 does not uniformly decrease the pumping rate to prevent the lug-down of the engine 11, the movement of the hydraulic actuators is not slowed down more than necessary, and the operability of the shovel 1 is not excessively degraded.

The engine controller 35 also calculates a fuel injection limiting value based on the boost pressure, and controls the fuel injector according to the fuel injection limiting value. The fuel injection limiting value may include a maximum allowable fuel injection amount that is determined according to the boost pressure, and fuel injection timing.

An engine speed adjusting dial 75, which is an engine speed setter, is used to adjust a target engine speed. In the present embodiment, the engine speed adjusting dial 75 is provided in a cabin of the shovel 1 and allows an operator of the shovel 1 to set the target engine speed at one of four levels. Also, the engine speed adjusting dial 75 sends data indicating the set target engine speed to the controller 30.

More specifically, the operator can set the engine speed by selecting one of four modes including a work priority mode, a normal mode, an energy-saving priority mode, and an idling mode. In FIG. 2, it is assumed that the energy-saving priority mode is selected with the engine speed adjusting dial 75. The work priority mode is a speed mode that is selected to give priority to the workload, and uses the highest engine speed among the four modes. The normal mode is a speed mode that is selected to satisfy both the workload and the fuel efficiency, and uses the second highest engine speed among the four modes. The energy-saving priority mode is a speed mode that is selected to operate the shovel 1 with low noise while giving priority to the fuel efficiency, and uses the third highest engine speed among the four modes. The idling mode is a speed mode that is selected to cause the engine to idle, and uses the lowest engine speed among the four modes. The engine 11 is maintained at an engine speed corresponding to a mode selected by the engine speed adjusting dial 75.

Next, a process performed by the controller 30 to control the discharge rates (which may be referred to as "pumping rates") of the hydraulic pumps 10 according to negative control pressures is described.

In the present embodiment, the controller 30 increases or decreases the discharge rate of the hydraulic pump 10L by increasing or decreasing a control current supplied to the pump regulator 10*a*L and thereby increasing or decreasing the swash plate angle of the hydraulic pump 10L. For example, the controller 30 increases the discharge rate of the hydraulic pump 10L by increasing the control current as the negative pressure decreases. Although the discharge rate of the hydraulic pump 10L is described below, the descriptions can be applied also to the discharge rate of the hydraulic pump 10R.

Specifically, the hydraulic oil discharged by the hydraulic pump 10L passes through the center bypass pipe line 20L, reaches the negative control throttle 21L, and generates a negative control pressure at a position upstream of the negative control throttle 21L.

For example, when the control valve 175L is moved to operate the arm cylinder 8, the hydraulic oil discharged by the hydraulic pump 10L flows via the control valve 175L into the arm cylinder 8. As a result, the amount of the hydraulic oil reaching the negative control throttle 21L decreases or becomes zero, and the negative control pressure generated upstream of the negative control throttle 21L decreases.

According to the decrease in the negative control pressure detected by the pressure sensor S1, the controller 30 increases the control current supplied to the pump regulator 10*a*L. According to the increase in the control current from the controller 30, the pump regulator 10*a*L increases the swash plate angle of the hydraulic pump 10L and thereby increases the discharge rate. As a result, a sufficient amount of the hydraulic oil is supplied to the arm cylinder 8, and the arm cylinder 8 is properly driven.

Then, when the control valve 175L is returned to a neutral position to stop the operation of the arm cylinder 8, the hydraulic oil discharged by the hydraulic pump 10L reaches the negative control throttle 21L without flowing into the arm cylinder 8. As a result, the amount of the hydraulic oil reaching the negative control throttle 21L increases, and the negative control pressure generated upstream of the negative control throttle 21L increases.

According to the increase in the negative control pressure detected by the pressure sensor S1, the controller 30 decreases the control current supplied to the pump regulator 10*a*L. According to the decrease in the control current from the controller 30, the pump regulator 10*a*L decreases the swash plate angle of the hydraulic pump 10L and thereby decreases the discharge rate. As a result, a pressure loss (pumping loss) caused when the hydraulic oil discharged by the hydraulic pump 10L passes through the center bypass pipe line 20L is suppressed.

Hereafter, a process of controlling the pumping rate based on a negative control pressure as described above is referred to as a "negative control". With the negative control, the drive system 100 can reduce wasteful energy consumption in a standby state where the hydraulic actuators are not being operated. This is because the negative control can suppress the pumping loss caused by the hydraulic oil discharged by the hydraulic pumps 10. Also, the drive system 100 can supply a sufficient amount of the hydraulic oil from the hydraulic pumps 10 to the hydraulic actuators to drive the hydraulic actuators.

The drive system 100 also performs a horsepower control in parallel with the negative control. In the horsepower control, the drive system 100 decreases the pumping rate as the discharge pressure (which is hereafter referred to as a "pump discharge pressure) of the hydraulic pump 10 increases. This is to prevent the occurrence of over torque. In other words, the horsepower control is performed to prevent the absorbing horsepower (pump absorption torque) of the hydraulic pump, which is represented by a product of the pump discharge pressure and the pumping rate, from exceeding the output horsepower (engine output torque) of the engine.

Figure 3:
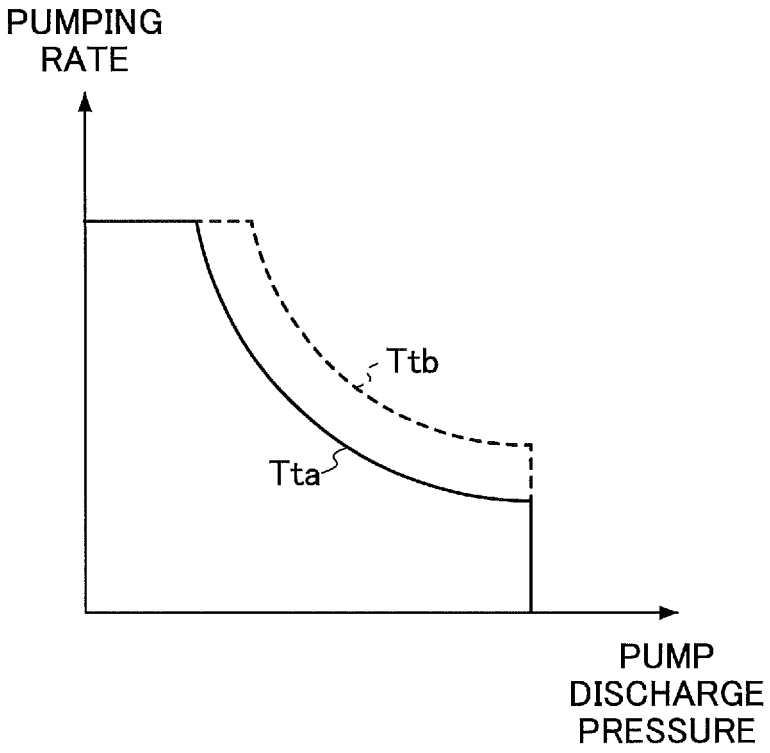
FIG. 3 is a horsepower control diagram (PQ diagram) illustrating a relationship between a pumping rate and a pump discharge pressure.

FIG. 3 is a horsepower control diagram (PQ diagram) illustrating a relationship between the pumping rate and the pump discharge pressure. In FIG. 3, the vertical axis indicates the pumping rate and the horizontal axis indicates the pump discharge pressure. A horsepower control line indicates a tendency that the pumping rate increases as the pumping discharge pressure decreases. Also, a horsepower control line is determined according to target pump absorption torque. As the target pump absorption torque increases, the horsepower control line shifts in an upper-right direction. FIG. 3 indicates that target pump absorption torque Tta corresponding to a horsepower control line represented by a solid line is smaller than target pump absorption torque Ttb corresponding to a horsepower control line represented by a dotted line. The target pump absorption torque is set in advance as maximum allowable pump absorption torque that the hydraulic pump 10 can output. Although the target pump absorption torque is set in advance as a fixed value in the present embodiment, the target pump absorption torque may instead be a variable.

In the present embodiment, to drive the hydraulic pump 10 at the target pump absorption torque, the controller 30 controls the displacement of the hydraulic pump 10 according to a horsepower control line as illustrated in FIG. 3. Specifically, the controller 30 calculates a target displacement based on a pumping rate corresponding to a pump discharge pressure detected by the pressure sensor S3. Then, the controller 30 outputs a control current corresponding to the target displacement to the pump regulator 10*a*. The pump regulator 10*a* increases or decreases the swash plate angle according to the control current so that the displacement of the hydraulic pump 10 matches the target displacement. With the feedback control of the pump absorption torque as described above, the controller 30 can drive the hydraulic pump 10 at the target pump absorption torque even when the pump discharge pressure varies due to the variation of the load of a hydraulic actuator. Also, the engine controller 35 adjusts engine output torque by a feedback control by referring to, for example, the actual engine speed and the boost pressure, to maintain a target engine speed specified by the controller 30 (isochronous control).

However, as long as the feedback control as described above is performed, the controller 30 cannot eliminate a response delay time necessary to actually change the pumping rate after a variation in the pump discharge pressure is detected. This may cause the pump absorption torque to exceed the engine output torque. Similarly, the engine controller 35 cannot eliminate a response delay time necessary to actually change the engine output torque after a variation in the actual engine speed is detected. This may cause the actual engine speed to vary greatly (or deviate greatly from the target engine speed).

To eliminate the response delay time, the controller 30 employs a model predictive control. In the present embodiment, the controller 30 predicts, at a predetermined control cycle, an engine speed after a predetermined period of time based on the state quantity of the hydraulic pump 10 at the present time, and generates an engine speed command for the engine controller 35 at the predetermined control cycle. The state quantity of the hydraulic pump 10 at the present time may include, for example, a pump discharge pressure, a displacement, a swash plate angle, and pump absorption torque (hydraulic load). Also, the controller 30 may be configured to predict, for example, the load of the engine 11 and a decrease in the engine speed, and generate an engine speed command based on the predicted values.

Figure 4:
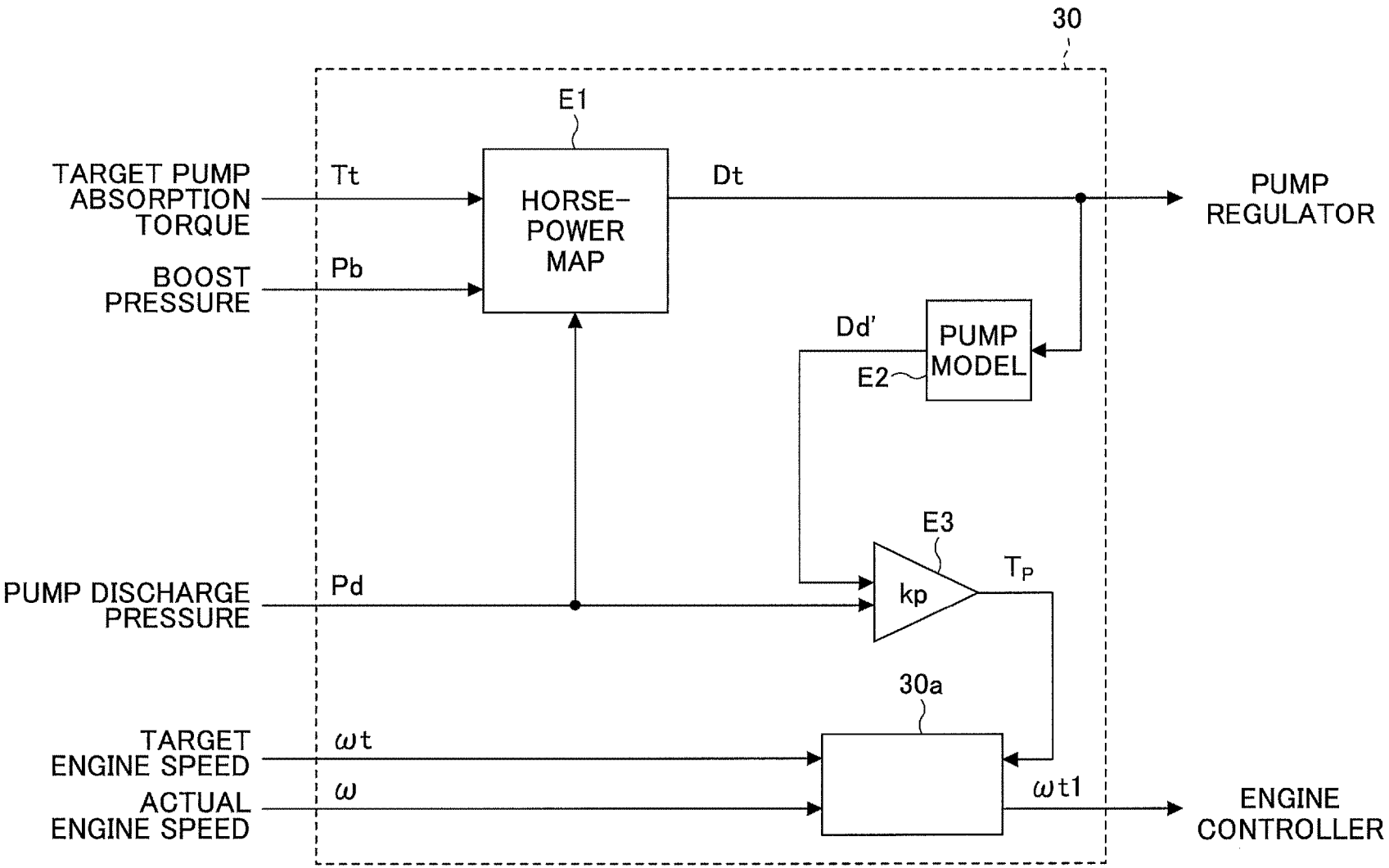
FIG. 4 is a block diagram illustrating an exemplary flow of control performed by a controller.

Next, an exemplary flow of control performed by the controller 30 is described with reference to FIG. 4. FIG. 4 is a block diagram illustrating an exemplary flow of control performed by the controller 30. In FIG. 4, it is assumed that the arm 5 is independently operated.

First, the controller 30 reads target pump absorption torque (Tt) that is preset in, for example, the NVRAM. Also, the controller 30 obtains a boost pressure (Pb) of the booster of the engine 11 that is detected by the boost pressure sensor S6. Then, the controller 30 adjusts the target pump absorption torque (Tt) at an arithmetical element E1.

The arithmetical element E1 adjusts the target pump absorption torque (Tt) according to the boost pressure (Pb). For example, when the boost pressure (Pb) is greater than or equal to a predetermined value, the arithmetical element E1 adjusts the target pump absorption torque Tta to the target pump absorption torque Ttb as illustrated in FIG. 3, and uses the dotted horsepower control line corresponding to the target pump absorption torque Ttb instead of the solid horsepower control line corresponding to the target pump absorption torque Tta. The arithmetical element E1 may be configured to additionally or alternatively adjust the target pump absorption torque (Tt) according to a fuel injection limiting value output from the engine controller 35. Also, the arithmetical element E1 may be configured to adjust the target pump absorption torque by referring to a correspondence table (correspondence map) that stores the correspondence between boost pressures (Pb) or fuel injection limiting values and target pump absorption torque (Tt), or configured to adjust the target pump absorption torque by using a predetermined formula. With the above configuration, the controller 30 can prevent the target pump absorption torque from being set at an excessively high value when the boost pressure of the engine 11 is low at the start of the operation of a hydraulic actuator. Thus, the controller 30 can prevent the occurrence of over torque, and can also prevent a delay in the recovery of the engine speed after its decrease due to a notable influence of a turbo lag.

Then, based on the target pump absorption torque adjusted by the arithmetic element E1, the controller 30 calculates a target displacement (Dt) of the hydraulic pump 10 as a swash-plate angle command.

Specifically, the arithmetic element E1 calculates a pumping rate corresponding to the pump discharge pressure in the horsepower control. In the present embodiment, for example, the arithmetic element E1 refers to the horsepower control line as illustrated in FIG. 3, and calculates a target displacement (Dt) corresponding to a pump discharge pressure (Pd) of the hydraulic pump 10L detected by the pressure sensor S3.

Then, the pump regulator 10*a*L receives a control current corresponding to the target displacement (Dt) and changes the actual displacement [cc/rev] of the hydraulic pump 10L according to the control current.

FIG. 4 also illustrates a process where the target displacement (Dt) is converted into an estimated value (Dd') of the actual displacement [cc/rev] via an arithmetic element E2 that is a pump model of the hydraulic pump 10L. Specifically, the controller 30 electrically controls the pumping rate of the hydraulic pump 10L based on the target displacement (Dt). For this reason, it is possible to estimate the actual displacement [cc/rev] by using a pump model (a virtual swash-plate angle sensor) of the hydraulic pump 10L. This configuration enables the controller 30 to estimate pump absorption torque (Tp) without using a swash-plate angle sensor, and makes it possible to improve the responsiveness in the engine speed control while suppressing a cost increase. In the present embodiment, the pump model of the hydraulic pump 10L is generated based on input-output data during actual operations of the hydraulic pump 10L.

After the above process, the hydraulic pump 10L discharges the hydraulic oil at a pumping rate that is determined by the actual displacement [cc/rev] controlled by the pump regulator 10*a*L and the pump speed of the hydraulic pump 10L corresponding to the actual engine speed (ω) of the engine 11.

Next, a flow of control for adjusting a target engine speed (ωt) according to pump absorption torque (Tp) is described.

First, a model prediction controller 30*a* of the controller 30 adjusts the target engine speed (ωt) based on the target engine speed (ωt), the actual engine speed (ω), and the pump absorption torque (Tp). Then, the model prediction controller 30*a* outputs an adjusted target engine speed (ωt1) as an engine speed command to the engine controller 35.

The model prediction controller 30*a* is a functional component that performs, in real time, a control (model prediction control) based on an optimal control theory by using a model for predicting the behavior of the engine 11 and the engine controller 35. The model prediction control of the engine 11 is performed by using a plant model of the engine 11. The plant model of the engine 11 enables obtaining an output of the engine 11 based on an input to the engine 11. In the present embodiment, the model prediction controller 30*a* can obtain predicted values of the actual engine speed (ω) and the engine output torque at a point in the future within a finite time based on the actual engine speed (ω) and the engine load torque (=pump absorption torque (Tp)) that are outputs of the engine 11 and the target engine speed (ωt) that is an input to the engine controller 35.

For example, the model prediction controller 30*a* obtains a predicted value of the engine speed after "n" control cycles in a case where a small variation (Δωt) is continuously applied to the target engine speed (ωt) (i.e., where the target engine speed varies by Δωt at every control cycle) while the engine load torque (pump absorption torque (Tp)) is present.

Also, the model prediction controller 30*a* obtains a predicted value of the engine speed after the "n" control cycles in a case where multiple small variation values obtained based on the small variation Δωt are continuously applied to the target engine speed ωt) throughout the "n" control cycles. Each of the small variation values may be obtained, for example, by adding a predetermined value to the small variation Δωt or by subtracting a predetermined value from the small variation Δωt.

The model prediction controller 30*a* selects, from the multiple small variation values, a small variation Δωc that minimizes the difference between the current target engine speed (ωt) and the engine speed (predicted value) after the "n" control cycles. Specifically, the model prediction controller 30*a* selects one of the small variation values including the small variation Δωt as the small variation Δωtc to be used for the current control cycle.

Then, the model prediction controller 30*a* adds the selected small variation Δωtc to the target engine speed (ωt) to obtain an adjusted target engine speed (ωt1), and outputs the adjusted target engine speed (ωt1) as an engine speed command to the engine controller 35. The engine controller 35 obtains a fuel injection amount (Qi) based on the adjusted target engine speed (ωt1) output from the model prediction controller 30*a*.

In the above descriptions, it is assumed that the engine load torque input to the model prediction controller 30*a* is the same as the pump absorption torque (Tp). However, the engine load torque may instead be a value that is obtained by adding no-load loss torque and/or a viscous resistance to the pump absorption torque (Tp). Further, based on the predicted value, the model prediction controller 30*a* can obtain an adjusted target engine speed (ωt1) that provides engine output torque (fuel injection amount) that is necessary to maintain the target engine speed (ωt) and corresponds to the pump absorption torque (Tp), and output the adjusted target engine speed (ωt1) to the engine controller 35.

Specifically, the model prediction controller 30*a* obtains the target engine speed (ωt) from the engine speed adjusting dial 75, obtains the actual engine speed (ω) from the engine speed sensor S5, and obtains the pump absorption toque (Tp) from an arithmetic element E3.

The arithmetic element E3 is a functional component that calculates the pump absorption toque (Tp) based on the estimated value (Dd') of the actual displacement [cc/rev] of the hydraulic pump 10L and the pump discharge pressure (Pd) of the hydraulic pump 10L that is detected by the pressure sensor S3.

Also, when the arithmetic element E2, which is a pump model, is incorporated into the model prediction controller 30*a*, the model prediction controller 30*a* can calculate the pump absorption torque (Tp) based on past variations of the pump absorption torque (Tp). This configuration makes it possible to more accurately obtain a predicted value of the engine speed.

Figure 5:
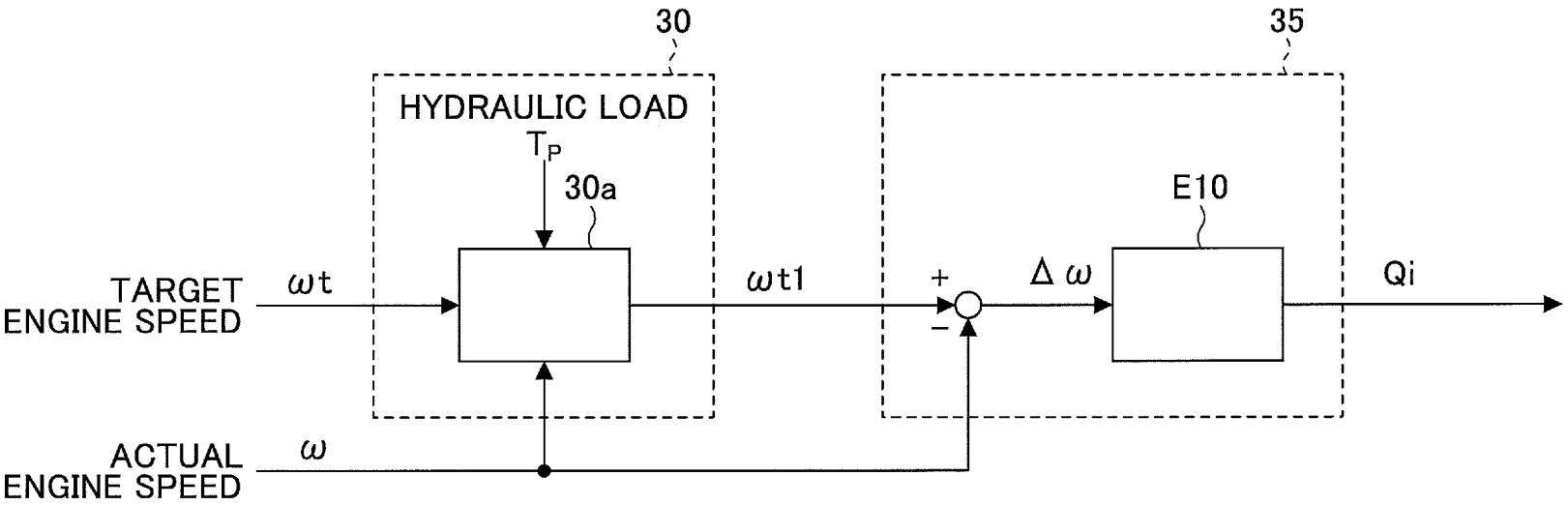
FIG. 5 is a block diagram illustrating an exemplary flow of control performed by an engine controller.

Next, an exemplary flow of control performed by the engine controller 35 is described with reference to FIG. 5. FIG. 5 is a block diagram illustrating an exemplary flow of control performed by the engine controller 35.

First, the engine controller 35 obtains a deviation (Δω) between the adjusted target engine speed (ωt1) and the actual engine speed (ω).

Then, the engine controller 35 calculates the fuel injection amount (Qi) via an arithmetic element E10.

The arithmetic element E10 is comprised of an anti-windup controller and a PID controller, and prevents the saturation of the deviation (Δω) that is a control input.

Then, the engine controller 35 obtains an adjusted fuel injection amount corresponding to the current boost pressure (Pb) by referring to a correspondence table (correspondence map) that stores the correspondence between boost pressures and fuel injection amounts.

Also, the engine controller 35 calculates a difference between the fuel injection amount (Qi) and the adjusted fuel injection amount, and feeds back the difference to the arithmetic element E10. This is to prevent integral windup. Then, the fuel injector of the engine 11 injects an amount of fuel corresponding to the adjusted fuel injection amount.

Thus, the above configuration of the drive system 100 makes it possible to suppress the variation in the engine speed by inputting, to the engine controller 35, the adjusted target engine speed (ωt1) that provides engine output torque (fuel injection amount) corresponding to the pump absorption torque (Tp). Compared with a configuration where the engine speed is maintained solely by a feedback control of the engine speed, i.e., the isochronous control performed by the engine controller 35, the above configuration of the drive system 100 can provide characteristics that are close to the characteristics of a torque control (where the engine output torque is directly adjusted according to the pump absorption torque). Accordingly, the configuration of the drive system 100 makes it possible to maintain the engine speed at a substantially constant level while suppressing a response delay resulting from the feedback control. Also, unlike the torque control, the configuration of the drive system 100 does not require the operator of the shovel 1 to manually control the engine speed taking into account the characteristic of the engine 11.

Also, the drive system 100 includes the model prediction controller 30*a* that performs a model prediction control of the engine 11. The model prediction controller 30*a* makes it possible to indirectly adjust the engine controller 35. This in turn eliminates the need to modify the engine controller 35 itself even when the control procedure is changed, and thereby makes it possible to reduce the development costs.

Figure 6:
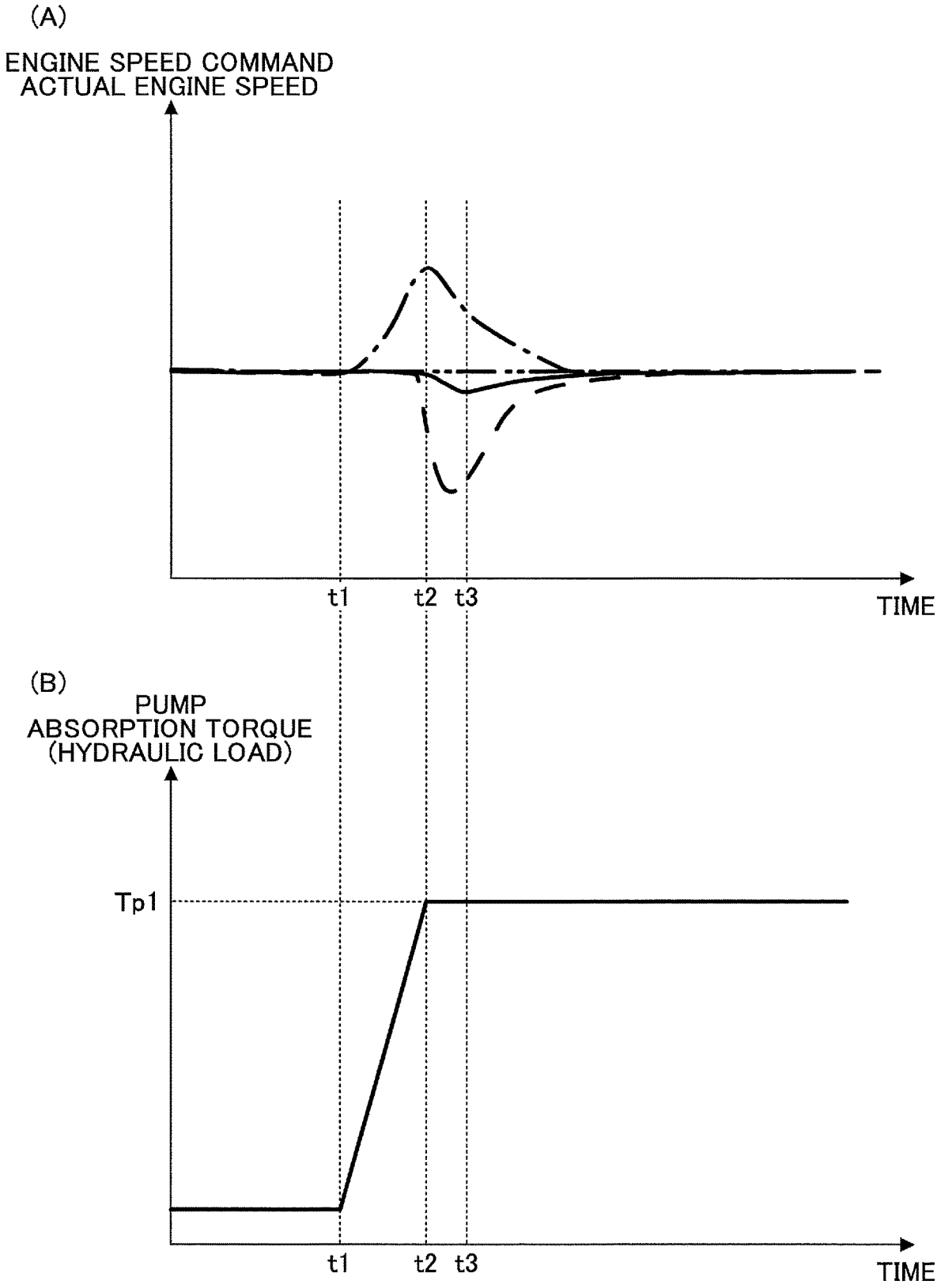
FIG. 6 is a graph illustrating changes over time in an engine speed command, an actual engine speed, and pump absorption torque (hydraulic load)

Next, the effects of the model prediction control in suppressing the variation in the actual engine speed resulting from an increase in the pump absorption torque are described with reference to FIG. 6. FIG. 6 is a graph illustrating changes over time in the engine speed command, the actual engine speed, and the pump absorption torque (hydraulic load). In FIG. 6 (A), a solid line indicates changes in the actual engine speed in a case where the model prediction control is employed, and a dashed line indicates changes in the actual engine speed in a case where the model prediction control is not employed. Also in FIG. 6 (A), a one-dot chain line indicates changes in the engine speed command in the case where the model prediction control is employed, and a two-dot chain line indicates changes in the engine speed command in the case where the model prediction control is not employed. In FIG. 6 (B), a solid line indicates changes in the pump absorption torque that is common to the case where the model prediction control is employed and the case where the model prediction control is not employed.

In the case where the model prediction control is employed, when the pump absorption torque starts to increase at a time t1 as indicated by the solid line in FIG. 6 (B), the model prediction controller 30*a* of the controller 30 increases the engine speed command to be output to the engine controller 35 as indicated by the one-dot chain line in FIG. 6 (A). Here, the engine speed command is determined at predetermined time intervals based on the target engine speed set by the engine speed setter. Specifically, the engine speed command is determined so that the difference between the current target engine speed and the actual engine speed (predicted value) after "n" control cycles is minimized. Also, the engine speed command tends to increase as the pump absorption torque increases. When the hydraulic load decreases sharply, the actual engine speed becomes higher than the target engine speed and overshoots. Even in such a case, the controller 30 can generate an adjusted target engine speed that is lower than the target engine speed, and therefore can prevent the overspeeding of the engine 11. In the present embodiment, as indicated by the one-dot chain line in FIG. 6 (A), the engine speed command continues to increase until the pump absorption torque reaches the maximum value (a value Tp1 that is determined by the horsepower control line) at a time t2, and reaches the maximal value at substantially the same time as the pump absorption torque reaches the maximum value. That is, the engine speed command reaches the maximal value at a time earlier than a time t3 at which the actual engine speed reaches the minimal value. After that, the engine speed command gradually decreases and returns to the initial engine speed command (which is observed before the time t1). As a result, as indicated by the solid line in FIG. 6 (A), the actual engine speed only slightly and temporarily decreases up to the minimal value observed at the time t3 and is maintained at a substantially constant level. When the engine speed command is ideally predicted, the actual engine speed may not even slightly and temporarily decrease and is maintained at a constant level.

On the other hand, in the case where the model prediction control is not employed, the controller 30 does not change the engine speed command as indicated by the two-dot chain line in FIG. 6 (A). Accordingly, as indicated by the dashed line in FIG. 6 (A), the actual engine speed decreases comparatively greatly and then returns to a value corresponding to the engine speed command.

Thus, with the use of the model prediction control, the controller 30 can prevent the actual engine speed from decreasing drastically even when the pump absorption torque increases sharply.

Figure 7:
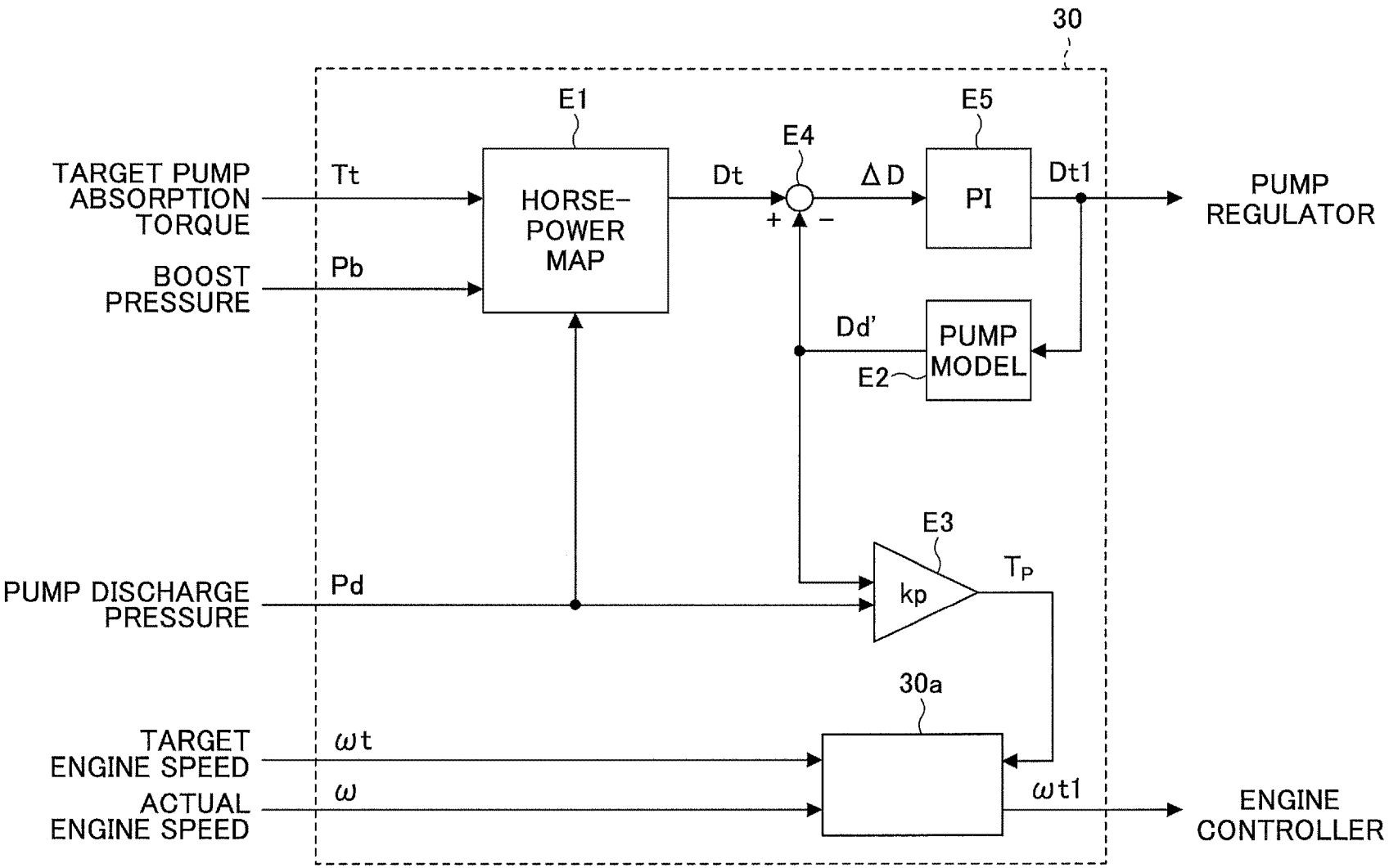
FIG. 7 is a block diagram illustrating another exemplary flow of control performed by a controller.

Next, another exemplary flow of control performed by the controller 30 is described with reference to FIG. 7. FIG. 7 is a block diagram illustrating another exemplary flow of control performed by the controller 30 and is a variation of FIG. 4. In FIG. 7, similarly to FIG. 4, it is assumed that the arm 5 is independently operated.

The flow of control of FIG. 7 is different from the flow of control of FIG. 4 in that a deviation (ED) between a target displacement (Dt) and an estimated value (Dd') of the current actual displacement [cc/rev] is calculated by an arithmetic element E4, and an adjusted target displacement (Dt1) is obtained by an arithmetic element E5 by adjusting the target displacement (Dt) such that the deviation (ΔD) becomes close to zero. Other parts of FIG. 7 are substantially the same as those of FIG. 4. Below, descriptions of the same parts are omitted, and different parts are described in detail.

The arithmetic element E4 is a subtracter that outputs the deviation (ΔD) by subtracting the estimated value (Dd') of the current actual displacement [cc/rev] from the target displacement (Dt). In the present embodiment, the estimated value (Dd') of the current actual displacement [cc/rev] is based on the adjusted target displacement (Dt1) obtained by the arithmetic element E5, and is calculated by using the pump model of the arithmetic element E2 as a current swash-plate angle. The arithmetical element E5 is a PI controller that adjusts the target displacement (Dt) according to the deviation (ΔD).

Figure 8:
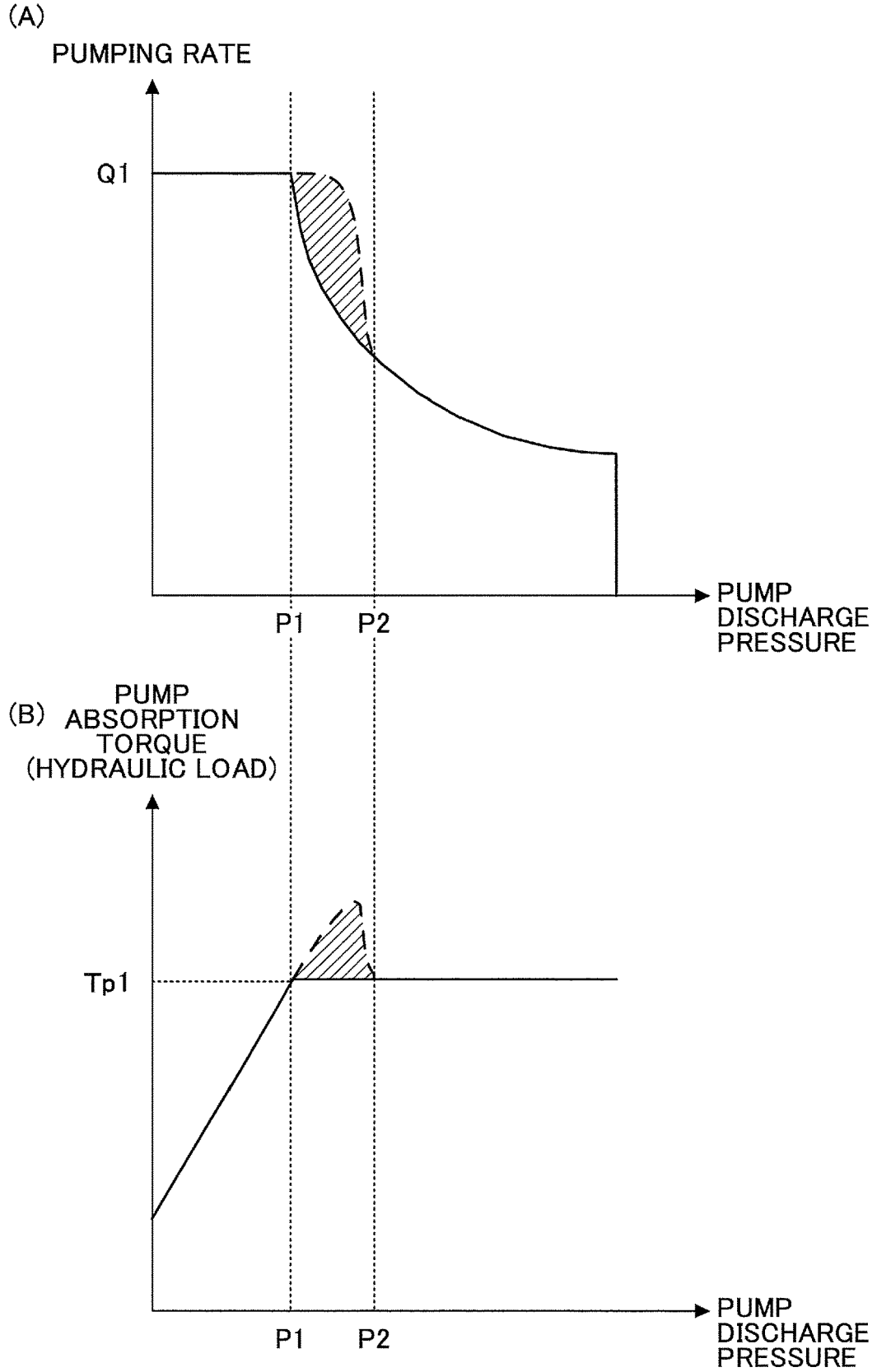
FIG. 8 is a graph illustrating a relationship between a pumping rate and a pump discharge pressure, and a relationship between pump absorption torque and a pump discharge pressure.

Next, effects provided by the arithmetic element E5, which is a PI controller, are described with reference to FIG. 8. FIG. 8 is a graph illustrating a relationship between a pumping rate and a pump discharge pressure, and a relationship between pump absorption torque and a pump discharge pressure. The vertical axis of FIG. 8 (A) indicates the pumping rate, and the vertical axis of FIG. 8 (B) indicates the pump absorption torque. Also, the horizontal axes of FIG. 8 (A) and FIG. 8 (B) indicate the pump discharge pressure and correspond to each other. FIG. 8 (A) is a horsepower control diagram and corresponds to FIG. 3.

When the arm 5 is operated, the hydraulic pump 10L supplies the hydraulic oil to the arm cylinder 8 at a pumping rate Q1 as indicated in FIG. 8 (A). When the pump discharge pressure increases and reaches a value P1, the controller 30 decreases the pumping rate to follow a horsepower control line in FIG. 8 (A). At this timing, the pump absorption torque reaches a value Tp1 that is determined by the horsepower control line as indicated by a solid line in FIG. 8 (B). Thereafter, as long as the pump discharge pressure is greater than or equal to the value P1, the controller 30 increases or decreases the pumping rate to follow the horsepower control line in FIG. 8 (A). As a result, the pump absorption torque is maintained at the value Tp1 that is determined by the horsepower control line as indicated by the solid line in FIG. 8 (B).

However, in a case where the arithmetic element E5 as a PI controller is not employed, a response delay resulting from the feedback control of the pumping rate increases, and it may become difficult to quickly and appropriately decrease the pumping rate in response to an increase in the pump discharge pressure. Specifically, when the pump discharge pressure sharply increases from a value less than the value P1 and exceeds a value P2, the controller 30 may become unable to decrease the pumping rate to follow the horsepower control line in FIG. 8 (A). In this case, the pumping rate temporarily exceeds the value determined by the horsepower control line, and the pump absorption torque also temporarily exceeds the value Tp1 determined by the horsepower control line. A hatched area in FIG. 8 (A) indicates the pumping rate exceeding the value determined by the horsepower control line, and a hatched area in FIG. 8 (B) indicates the pump absorption torque exceeding the value Tp1 determined by the horsepower control line.

The arithmetic element E5 implemented by a PI controller can reduce or prevent the occurrence of the above situation. Specifically, the arithmetic element E5 makes it possible to comparatively quickly decrease the pumping rate even when the pump discharge pressure sharply increases beyond the value P1, and makes it possible to suppress or prevent the pumping rate from exceeding the value determined by the horsepower control line. This in turn makes it possible to suppress or prevent the pump absorption torque from exceeding the value Tp1 determined by the horsepower control line.

Figure 9:
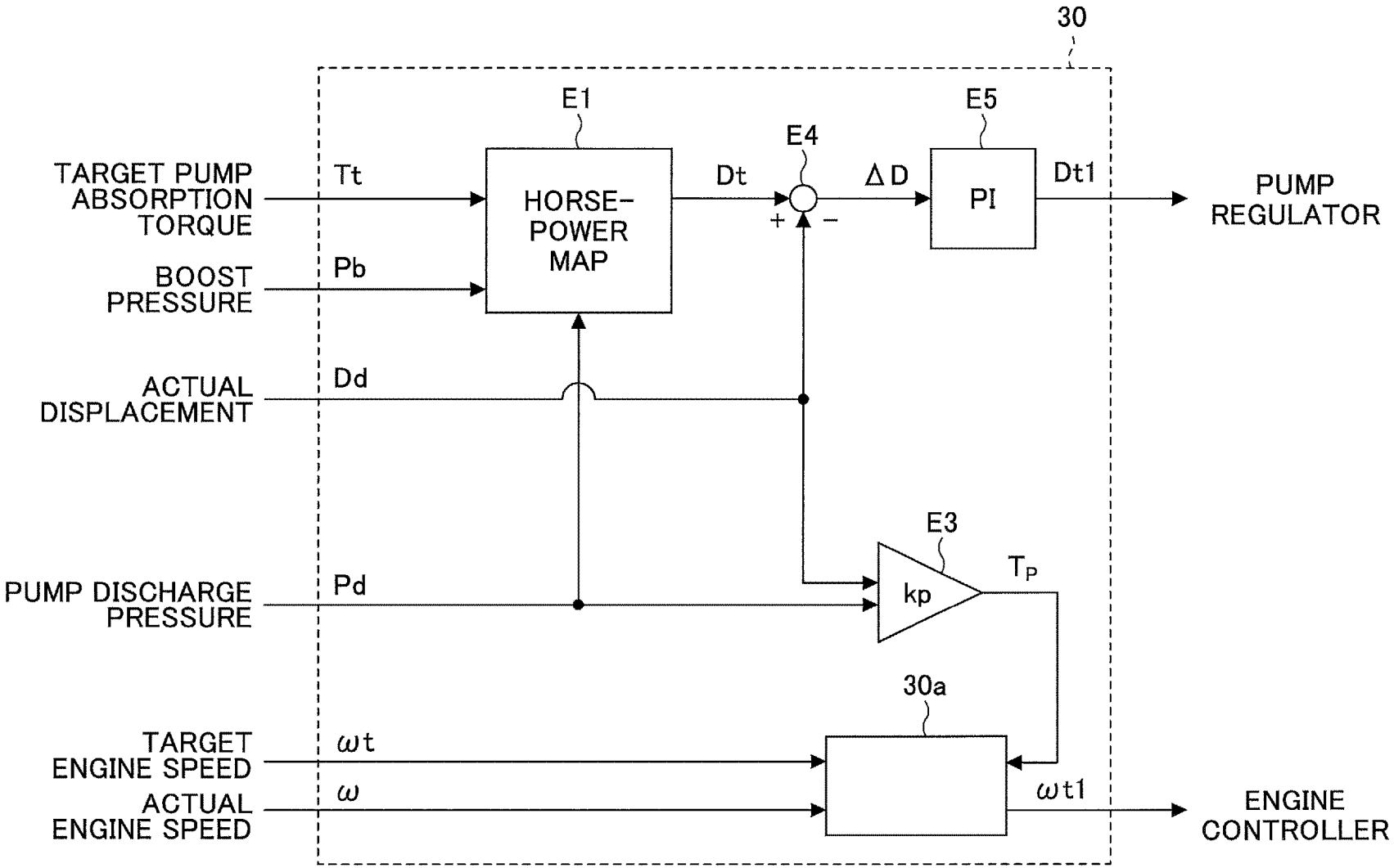
FIG. 9 is a block diagram illustrating still another exemplary flow of control performed by a controller.

Next, still another exemplary flow of control performed by the controller 30 is described with reference to FIG. 9. FIG. 9 is a block diagram illustrating still another exemplary flow of control performed by the controller 30 and is a variation of FIG. 7. In FIG. 9, similarly to FIG. 7, it is assumed that the arm 5 is independently operated.

The flow of control of FIG. 9 is different from the flow of control of FIG. 7 in that the arithmetic element E2, which is a pump model, is omitted, a swash-plate angle sensor is added, and a value detected by the swash-plate angle sensor is input to each of the arithmetic element E3 and the arithmetic element E4. Other parts of FIG. 9 are substantially the same as those of FIG. 7. Below, descriptions of the same parts are omitted, and different parts are described in detail.

In FIG. 9, the arithmetic element E4 outputs a deviation (ΔD) by subtracting a current actual displacement (Dd) detected by the swash-plate angle sensor from the target displacement (Dt). Also in FIG. 9, the arithmetic element E3 calculates the pump absorption toque (Tp) based on the actual displacement (Dd) of the hydraulic pump 10L detected by the swash-plate angle sensor and the pump discharge pressure (Pd) of the hydraulic pump 10L detected by the pressure sensor S3. Specifically, the arithmetic element E3 calculates the pump absorption toque (Tp) by multiplying the current actual displacement (Dd) by a predetermined proportional gain (Kp) corresponding to the pump discharge pressure (Pd).

With this configuration, the flow of control of FIG. 9 provides effects similar to those provided by the flow of control of FIG. 7, and also makes it possible to more accurately and stably control the actual engine speed (ω).

Also, the controller 30 may be configured to calculate the pump absorption toque (Tp) based on the pressure of the hydraulic oil in the hydraulic actuator detected by the pressure sensor S7. For example, when the arm 5 is independently operated in a closing direction, the controller 30 may calculate the pump absorption toque (Tp) based on the pressure of the hydraulic oil in a bottom-side oil chamber of the arm cylinder 8.

Figure 10:
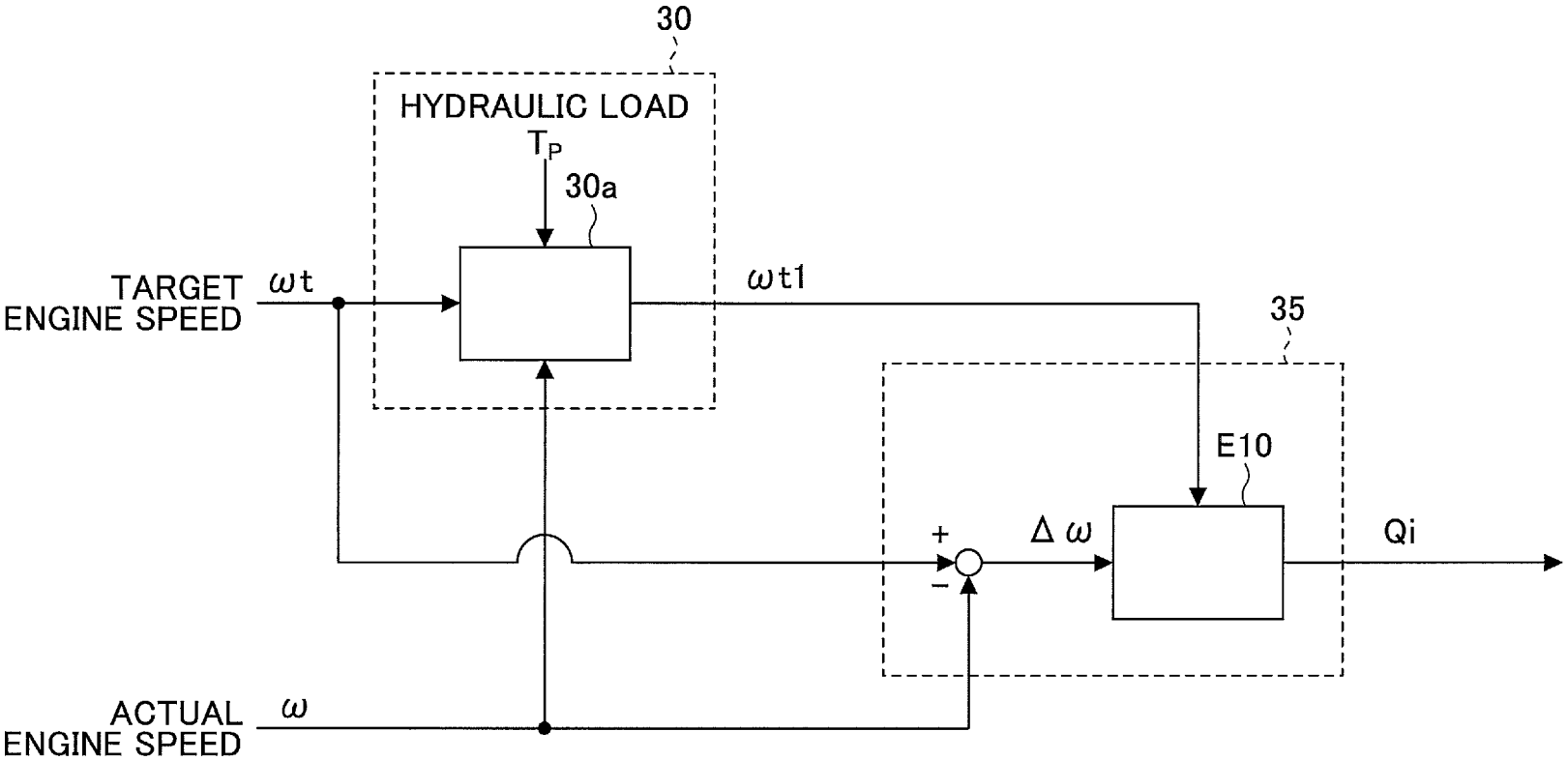
FIG. 10 is a block diagram illustrating another exemplary flow of control performed by an engine controller.

Next, another exemplary flow of control performed by the engine controller 35 is described with reference to FIG. 10. FIG. 10 is a block diagram illustrating another exemplary flow of control performed by the engine controller 35 and is a variation of FIG. 5.

The flow of control of FIG. 10 is different from the flow of control of FIG. 5 in that the engine controller 35 calculates a deviation (Δω) between a target engine speed (ωt) and an actual engine speed (ω), and the arithmetic element E10 calculates a fuel injection amount (Qi) based on an adjusted target engine speed (ωt1) output from the model prediction controller 30*a* and the deviation (Δω). Other parts of FIG. 10 are substantially the same as those of FIG. 5. Below, descriptions of the same parts are omitted, and different parts are described in detail.

Different from the engine controller 35 of FIG. 5, the engine controller 35 of FIG. 10 receives the target engine speed (ωt) instead of the adjusted target engine speed (ωt1) and calculates the deviation (Δω) between the target engine speed (ωt) and the actual engine speed (ω).

Also, different from the arithmetic element E10 of FIG. 5, the arithmetic element E10 of FIG. 10 receives the adjusted target engine speed (ωt1) in addition to the deviation (Δω), and calculates the fuel injection amount (Qi) while preventing the saturation of the deviation (Δω) as a control input.

With this configuration, the engine controller 35 of FIG. 10 can calculate the deviation (Δω) and adjust the fuel injection amount (Qi) taking into account the adjusted target engine speed (ωt1). Accordingly, compared with the engine controller 35 of FIG. 5, the engine controller 35 of FIG. 10 can more flexibly adjust the fuel injection amount (Qi) and can provide characteristics that are close to the characteristics of a torque control (where the engine output torque is directly adjusted according to the pump absorption torque).

A shovel according to an embodiment of the present invention is described above. However, the present invention is not limited to the specifically disclosed embodiment, and variations and modifications may be made without departing from the scope of the present invention.

For example, although the drive system 100 is used in the above embodiment to suppress the variation in the engine speed of the engine 11 of the shovel 1, the drive system 100 may also be used to suppress the variation in the engine speed of an engine used as a driving source of a power generator.

Also, although the controller 30 and the engine controller 35 are provided as separate components in the above embodiment, the controller 30 and the engine controller 35 may be combined into a single component.

What is claimed is:

1. A shovel, comprising:

a lower traveling body;

an upper rotating body;

an attachment including a boom and an arm;

a controller;

an engine; and a hydraulic pump that is driven by the engine and discharges hydraulic oil to drive the attachment, wherein the controller is configured to obtain a hydraulic load applied to the attachment, and increase an engine speed command as the hydraulic load increases and decrease the engine speed command after the hydraulic load increases, by predicting an engine speed that provides an engine output corresponding to the obtained hydraulic load based on the obtained hydraulic load and outputting the engine speed command corresponding to the predicted engine speed at predetermined time intervals.

2. The shovel as claimed in claim 1, wherein the engine speed command reaches a maximal value at substantially a same time as the hydraulic load reaches a maximum value.

3. The shovel as claimed in claim 1, wherein the engine speed command reaches a maximal value at a time earlier than a time at which an actual engine speed reaches a minimal value.

4. The shovel as claimed in claim 1, wherein the engine speed command is based on a decrease in the engine speed predicted based on the hydraulic load.

5. The shovel as claimed in claim 1, wherein the controller estimates the hydraulic load by using a model of the hydraulic pump.

6. The shovel as claimed in claim 1, wherein the controller estimates the hydraulic load based on a value detected by a swash-plate angle sensor.

7. The shovel as claimed in claim 1, wherein the controller estimates the hydraulic load based on a value detected by a hydraulic actuator pressure sensor.

8. The shovel as claimed in claim 1, wherein the controller determines a maximum allowable value of target pump absorption torque based on one of a boost pressure and a fuel injection limiting value.

9. The shovel as claimed in claim 1, wherein the hydraulic pump is a variable-displacement, swash-plate hydraulic pump, and is configured to change a swash-plate angle according to a swash-plate angle command from the controller; and the controller is configured to generate the swash-plate angle command according to a horsepower control based on a discharge pressure of the hydraulic pump and target pump absorption torque, and adjust the swash-plate angle command so that a deviation between a current swash plate angle received as feedback and the swash-plate angle command decreases.

10. The shovel as claimed in claim 1, wherein the controller obtains pump absorption torque based on a discharge pressure and a discharge rate of the hydraulic pump.

11. The shovel as claimed in claim 1, wherein the controller obtains a value detected by a toque sensor as pump absorption torque.

12. The shovel as claimed in claim 1, wherein the controller calculates the engine speed command in real time based on an optimal control theory by using a model for prediction of a behavior of the engine.

13. The shovel as claimed in claim 1, wherein the controller predicts the engine speed by adjusting a target engine speed set by an engine speed setter based on pump absorption torque, and outputs the adjusted target engine speed as the engine speed command.

14. The shovel as claimed in claim 13, wherein the controller outputs the engine speed command that is lower than the target engine speed in response to a sharp decrease in the hydraulic load that causes an actual engine speed to become higher than the target engine speed.

* * * * *